United States Patent [19]

Schmider et al.

[11] 4,223,558

[45] Sep. 23, 1980

[54] PIPETTING AND DILUTING APPARATUS

[75] Inventors: Paul Schmider; Herwig Mandl; Dietmar Ihlefeldt, all of Munich, Fed. Rep. of Germany

[73] Assignee: Beckman Instruments, GmbH, Munich, Fed. Rep. of Germany

[21] Appl. No.: 963,494

[22] Filed: Nov. 24, 1978

Related U.S. Application Data

[63] Continuation of Ser. No. 863,751, Dec. 23, 1977, abandoned.

[30] Foreign Application Priority Data

Dec. 23, 1976 [DE] Fed. Rep. of Germany ..... 2658486

[51] Int. Cl.[3] ..... B01L 3/02

[52] U.S. Cl. ..... 73/421 R; 422/100

[58] Field of Search ..... 73/425.6, 425.4 P; 222/63; 422/100; 128/DIG. 4

[56] References Cited

U.S. PATENT DOCUMENTS

| | | | |
|---|---|---|---|
| 3,335,724 | 8/1967 | Gienapp | 128/DIG. 1 |
| 3,665,980 | 5/1972 | Croslin | 222/63 |
| 3,677,651 | 6/1972 | Shapiro | 222/63 |
| 3,915,651 | 10/1975 | Nishi | 23/259 |
| 3,982,899 | 9/1976 | Kelm | 23/259 |

*Primary Examiner*—S. Clement Swisher

*Attorney, Agent, or Firm*—Robert J. Steinmeyer; Robert R. Meads; John R. Shewmaker

[57] ABSTRACT

Pipetting and diluting apparatus including an interchangeable syringe pump of predetermined volume capacity and a stepper motor for driving the syringe piston at a selected speed for dosing a selected volume of fluid. The piston stroke is calculated from the syringe volume capacity and the volume of fluid to be dosed. Control means controls the acceleration and deceleration characteristic of the piston in accordance with an exponential function dependent upon the selected piston speed and the syringe volume capacity.

4 Claims, 6 Drawing Figures

PIPETTING AND DILUTING APPARATUS

This is a continuation, of application Ser. No. 863,751, filed Dec. 23, 1977 now abandoned.

BACKGROUND OF THE INVENTION

1. Field of the Invention

This invention relates to a pipetting and diluting apparatus and, more particularly to apparatus for dosing of small quantities of liquids. The apparatus is particularly adapted for use with interchangeable pump modules and permits direct digital volume setting in milliliter or microliter units.

2. Description of the Prior Art

A large number of analyses conducted in laboratory practice of various fields of medicine, biology, chemistry and industry, frequently require the necessity that liquid samples with different viscosities have to be pipetted quantitatively in the microliter or milliliter range and diluted with reagents. For this kind of sample handling liquid delivery equipments having a set of two pumps are usually used in connection with values embodied into the pump modules and provided with an inlet and outlet port. Under suitable valve positions both, the sample and reagent, not necessarily of the same volume, will be sucked in simultaneously and discharged sequentially. A high accuracy is required related to volume setting and metering of very small quantities of a liquid.

Interchangeable piston displacement pump modules with different piston diameter are generally applied in order to cover a more extended volume range whereby a constant piston path is always correlated to the different total volumes of the pump cylinders. Furthermore, it is known to prior art that each of the pistons may be driven by means of a stepper motor under insertion of suitable transmission elements. Thus the total piston path within the pump cylinder will functionally correspond to a definite number of steps generated by the stepper motor in conjunction with the stepper driver.

A dosing apparatus is known and described in German Pat. No. 23 29 136 utilizing an interchangeable piston pump unit with direct volume control in fixed incremental steps. Push buttons activating mechanical stops provide means of volume control. Moreover each of the plugged-in piston pump units is provided with volume reading means as a digital label of which the numbers are positioned to the corresponding buttons. In such a way it is possible to set directly different liquid volumes, which are indicated on the appropriate pump unit. Equipments of this kind having direct volume setting are disadvantageous since each pump module has to be provided with a digital label which is specifically coordinated to their total volume and permits only in conjunction with the corresponding buttons a rough incremental graduation of setting related to the different volumes.

Furthermore a "Digital Diluter Dispenser" manufactured by the company Hamilton and described in a publication of the company Micromesure AG, Bonaduz, Switzerland, contains two interchangeable pump modules and can be applied as a diluter or as a pipetter by the use of interchangeable valve blocks. The piston of the Hamilton gastight syringes is driven by a stepper motor under insertion of a gear belt transmission and a gear rack.

Volume control is carried out as a percentage of total volume of the syringe on a two-digit switch which is a distinct disadvantage since it is a source of errors which cannot be excluded. Furthermore liquid quantities which correspond to the 100% capacity of the pump module can neither be taken in nor be dispensed.

In connection with a large number of analyses performed in a laboratory, microliter or milliliter quantities of liquid samples with different viscosity have frequently to be dosed. In order to guarantee a small dead volume in the lines of tubing and the valve blocks of the pipetter/diluter devices, the inside diameter of tubes and bores of valve bodies is kept as small as possible.

Since sample throughput is of high concern in the lab, the time of a complete cycle for aqueous samples should not exceed 5 seconds. Therefore a very high linear speed of the liquids becomes effective in the lines of tubing during the intake and discharge stroke and can reach values up to several centimeters per second. The known device of Hamilton using a stepper motor drive has the further disadvantage of a fixed slope of the start and stop characteristic of the piston motion controlled according to an established exponential function which is independent of the total volume of the pump module and of the preselected piston speed. In association therewith, a cavitation of liquids to be dosed can occur due to a temporary negative pressure within the pump body during the intake stroke and simultaneously an extension of the tubes during the discharge stroke.

Both (double-pump) systems mentioned before are not able to pipette small quantities of sample liquids quantitatively without adding diluents or reagents through the sample pump. A last drop remains on the tip of the pipet tubing due to adhesion and surface tension.

SUMMARY OF THE INVENTION

It is an object of the present invention to overcome all the aforementioned disadvantages and to provide a pipetting and diluting apparatus which guarantees a direct digital liquid volume preselection in microliter or milliliter units related to the useful range between 1 and 110% of the volume of the plugged-in pump module in such a manner that for modules of less than 1 ml total capacity a value of 1 $\mu$l and for modules of more than 1 ml total capacity a value of 10 $\mu$l can be set as smallest incremental volume.

It is a further object of the invention to provide an improved pipetting and diluting apparatus having the capability of controlling the slope of the start and stop characteristic of the piston motion according to a non-linear function, which is depending on total volume of the pump module and on preselected piston speed.

Another object of the invention is to provide an improved pipette capable of pipetting microliter quantities of liquids quantitatively without an additional dilution.

In achieving the above and other objects of the invention, a pipetting apparatus is provided, which comprises counting and comparator means for calculating automatically the piston stroke in dependence on the digital preselected quantity of liquid and on the total volume of the plugged-in pump module. The pipetting apparatus further include control means to control the slope of start and stop characteristic of the piston motion according to an exponential function wherein the digitally preselected speed and the total volume of module determine the slope characteristics. In accordance with another aspect of the invention, there are provided auxiliary pump and valve means to create a gas phase in the interchangeable tip of a hand pipette which separates the sample from the liquid end of the diluent eliminating diffusion of the one into the other.

The embodiment of the apparatus of the invention will now be described by way of example with reference to the accompanying drawings in which:

DESCRIPTION OF THE PREFERRED EMBODIMENT

Figure 1:
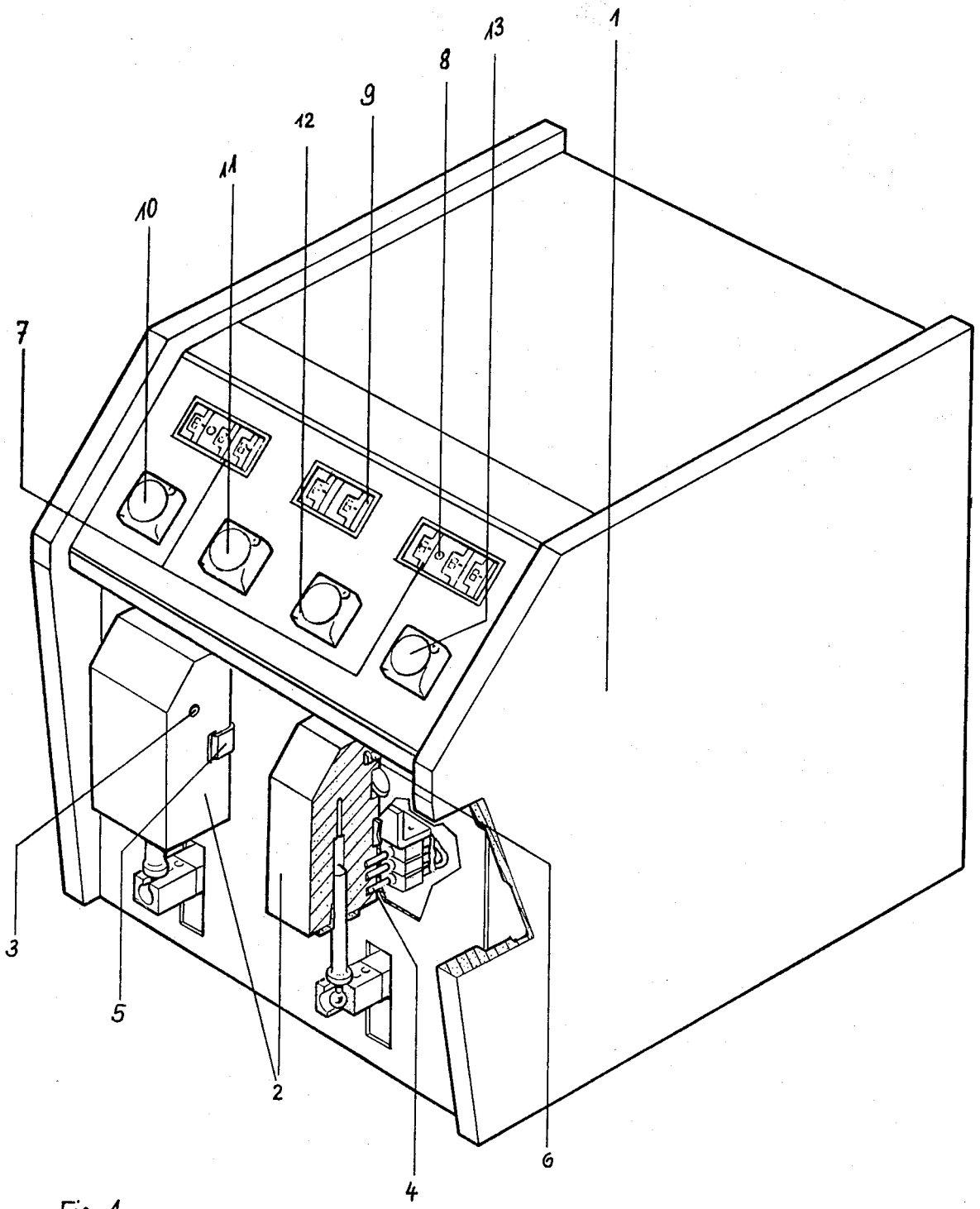
FIG. 1 is a perspective front view of the pipetting and diluting apparatus incorporating two interchangeable pump modules according to the invention, showing decoding pins of the rear of the pump modules.

A pipetting and diluting apparatus for microliter or milliliter quantities of liquids shown in FIG. 1 comprises a housing 1 on which two interchangeable pump modules 2 are arranged. The pump modules have built-in valves 3 interconnected through inlet and outlet tubes not being shown. Each of the pistons of the positive-displacement pumps is driven by means of a separate stepper motor. With the exception of the piston diameter, the pump modules 2 are identical so that always a constant path is resulting for different volumes.

On the rear of the pump modules 2 decoding pins 4 are mounted through which the total volume capacity will be programmed into the pipetting and diluting apparatus. Both pumps 2 are securely fastened on the low part of the front panel by means of a clamping mechanism 5 which enables an easy and rapid exchange. When plugging-in the pump modules 2, not only decoding pins 4 but also guide pins 6 for the switch valves 3 will engage in the instrument. Thumbwheel switches 7 serve for direct preselection of liquid volumes in microliter or milliliter units. The digital volume setting enables a range from 1% to 110% of the pump volume. It should be noted that the pump modules 2 have a 10% overrange to the nominal capacity. Overrange volumes which cannot be accepted by the pump module 2 in position will be indicated by flashing on the decimal point pilot light 8.

According to the physical properties fo each liquid the speed of the piston motion can be preselected for each pump by means of thumbwheel switches 9 in numerical values being variable from zero to nine, whereby speed zero corresponds to a standstill and speed nine to highest speed which is five seconds for a complete cycle. The half cycle and complete cycle operation is enabled by means of push buttons 10, 11 and 12. The instrument will be switched-on or switched-off by means of push button 13.

Figure 2:
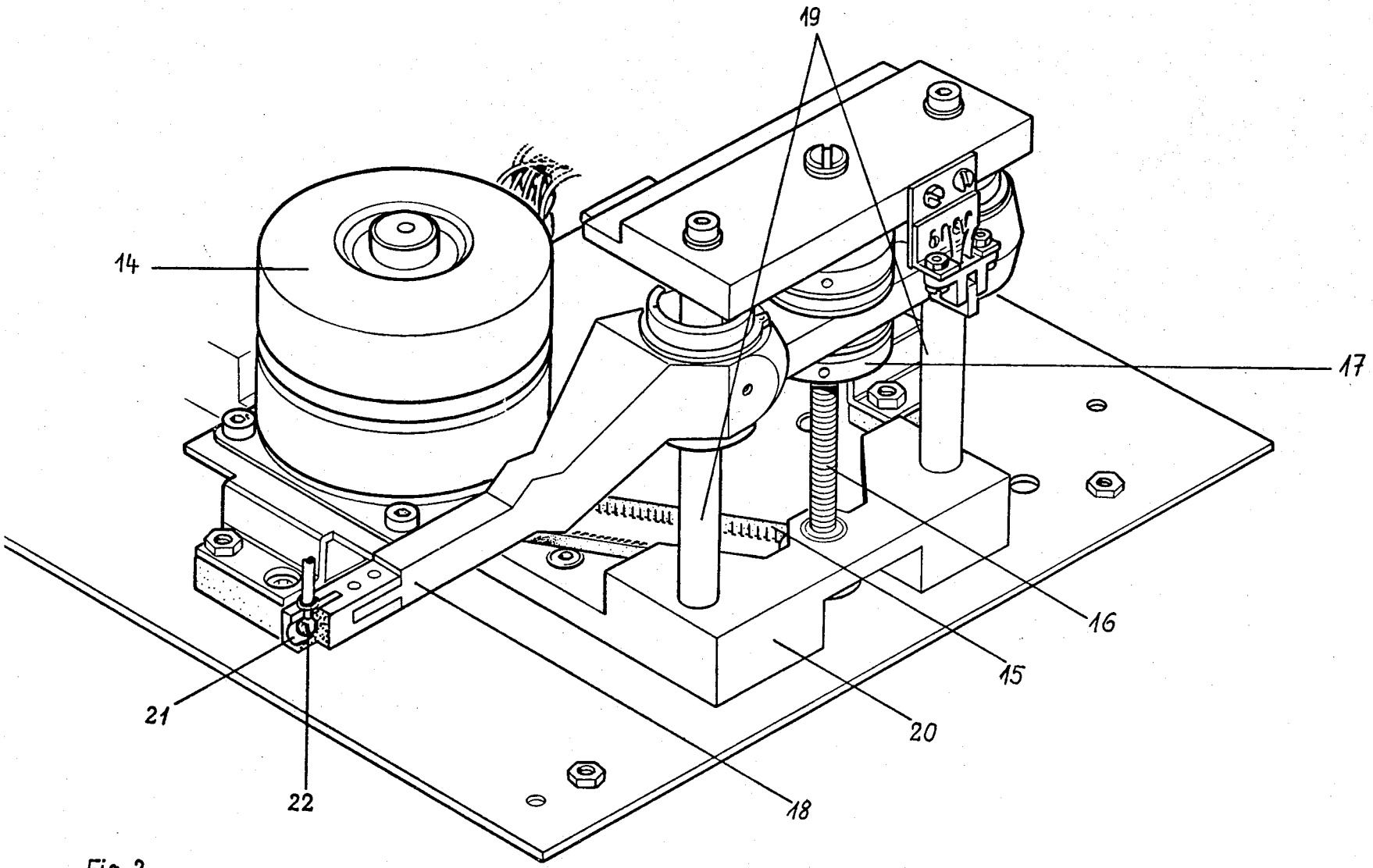
FIG. 2 is a schematic front view of the piston drive mechanism.

As shown in FIG. 2, each piston of the pump modules 2 is driven by an independent stepper motor 14 via a tooth belt transmission 15 and a threaded spindle 16, which is designed as a ballroller spindle. By means of a carriage 17, disposed on the threaded spindle 16 a lever arm 18 with piston actuator 21 is displaced for moving the piston of the pump in a vertical direction. The movable lever arm 18 is arranged betwen two guide rods 19 in order to transmit rotary motion of the threaded spindle 16 to linear motion of the lever arm 18. Guide rods 19 together with threaded spindle 16 are fixed within a common block 20. The ruby ball 22 of the piston engages into the mouth piece of the actuator 21.

In order to avoid cavitation within the pump cylinder and an over-extension of the flexible tubes, a start and stop characteristic of the piston stroke related to the start and stop positions of the motion is initiated being controlled according to an exponential function, which may be expressed in the form:

$$v = v_o(1 - e^{-(t/k_1 \cdot v_o \cdot V \cdot C)} \quad (1)$$

$v_o$ = digital preselected piston speed
V = total volume of the pump module plugged-in
t = variable time
$k_1$, C = parameters of the instrument.

Figure 3:
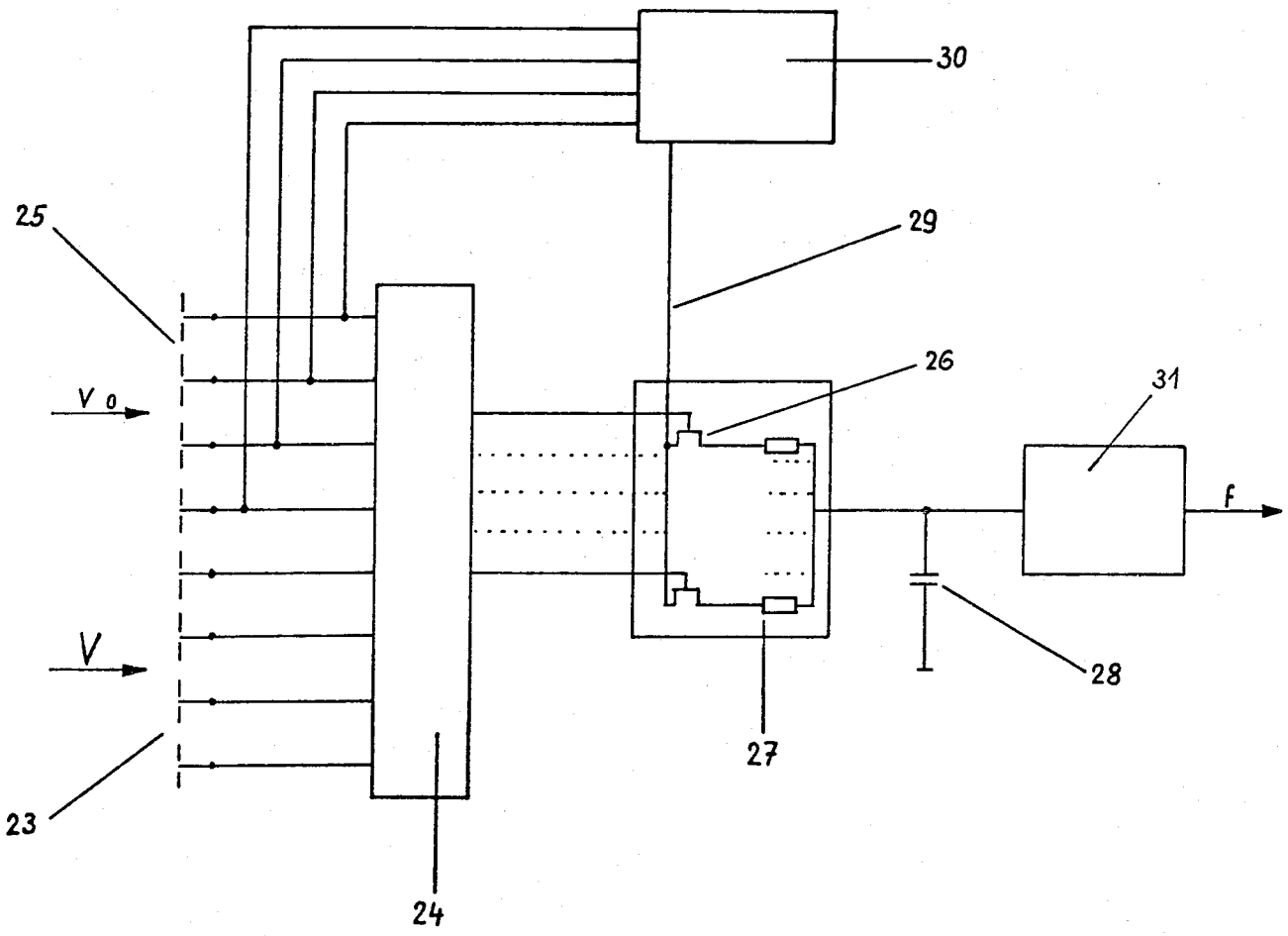
FIG. 3 shows a preferred embodiment of an electric circuit employed in controlling the start and stop characteristics of the piston motion.

This equation (1) reflects the time dependency of the linear speed of the piston in such a way that for higher volumes of the modules 2 and higher maximum speed the acceleration is more depressed. The electric control of the piston stroke according to equation (1) will be described more detailed with reference to FIG. 3 which represents the basic principle of the electronic circuit. The information of the total volume capacity V related to the pump module 2 being plugged in is written into a binary coded memory 24 via switches 23, which will be actuated by means of two decoding pins 4. As may further be seen in FIG. 3, the maximum speed $v_o$ of the piston preselected by switch 9 is fed to the memory 24 in binary coded form via switches 25. The total resistance R of the resistor network 27 is decoded through FET-switches 26 to be the product of total volume V and preselected piston speed $v_o$. The total resistance R can be written as $$R = k_1 \cdot V \cdot v_o \quad (2)$$

where $k_1$ is an instrument parameter.

The capacitor 28 connected to the resistor network 27 will be charged by means of a digital-to-analog converter 30 via the total resistance R and dc-voltage 29, so that the charging voltage U can be represented by an equation in the form $$U = U_o(1 - e^{-(t/R \cdot C)}) \quad (3)$$

where
$U_o$ = voltage (proportional to $v_o$)
t = variable time
R = total resistance of the resistor network
C = capacity Inserting equation (2) into equation (3), then the expression for the charging voltage U can be written as $$U = U_o \cdot (1 - e^{-(t/k_1 \cdot V \cdot v_o \cdot C)}) \quad (4)$$

By means of an analog-to-frequency-converter 31 the charging voltage U is then converted into a proportional frequency f, which is given by the equation $$f = k_2 \cdot U_o(1 - e^{-(t/k_1 \cdot V \cdot v_o \cdot C)}) \quad (5)$$

where $k_2$ is an instrument parameter. This means that the speed of the stepper motor 14 being proportional to the frequency f is increasing exponentially, thereby causing the piston speed to change according to equation (1) during the start characteristic until the preselected speed $v_o$ is reached. The same function of speed according to equation (1) is reflected to the piston path during the stop characteristic.

Figure 4:
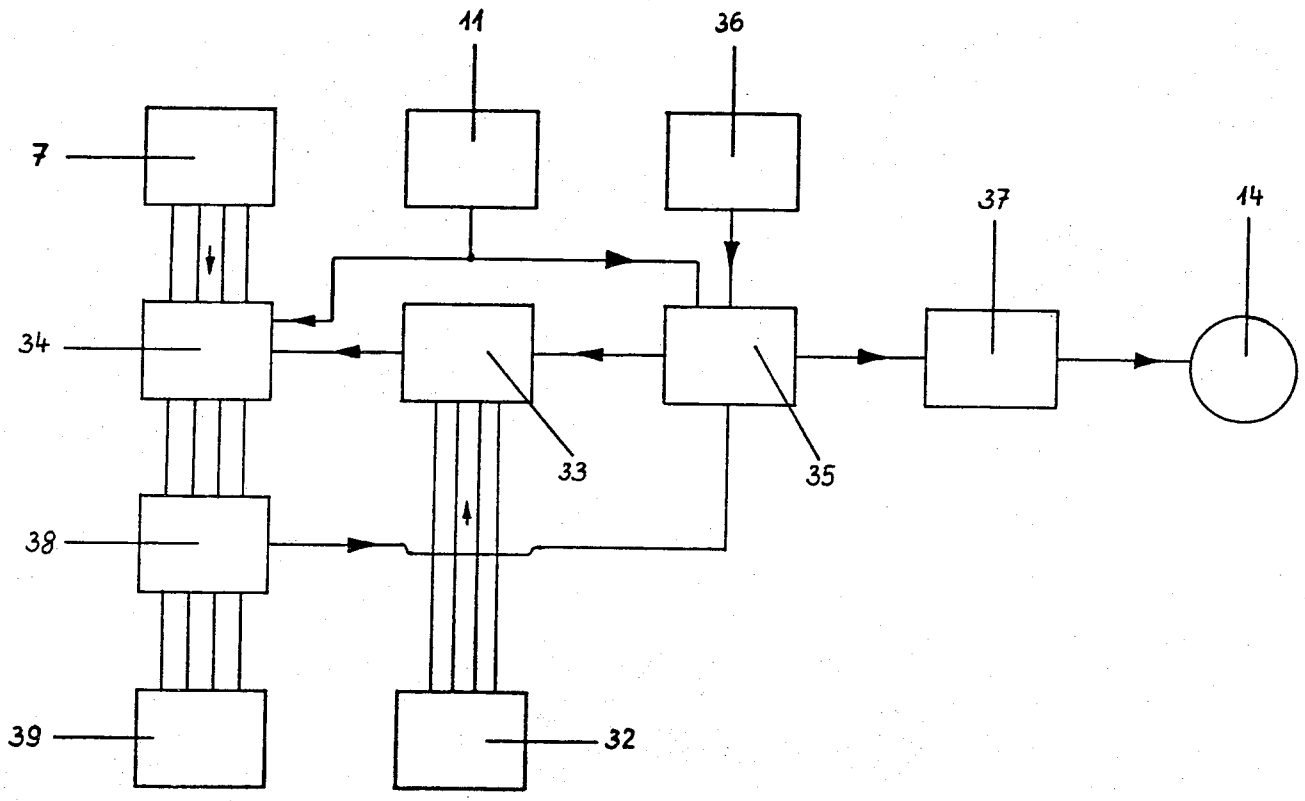
FIG. 4 shows a preferred embodiment of an electric circuit for the direct preselection of liquid volume.

An embodiment of the electronic circuit for the calculation of the piston stroke automatically in dependence on the digital preselected quantity of liquid and on the total volume of the plugged-in pump module 2 will now be described more detailed with reference to FIG. 4. As was noted hereinabove, the pump modules 2 are designed in such a manner that the maximum piston stroke within the pump cylinders remains always the same independent on their different total volumes. Each single pulse in a pulse train of high frequency generated by the inpulse generator 36 and passed by the open gate 35 is applied to the stepper driver 37 causing the stepper motor 14 to rotate one step for each such pulse, which corresponds to a definite piston stroke. Under these conditions the maximum piston stroke of pump modules 2 is always correlated with the same number of pulses delivered to the stepper divider 37 or of rotary steps actuated by the driving motor 14. The number of pulses functionally related to a quantity of liquid to be discharged and preselected by switch 7 is specifically dependent on the total volume capacity of pump module 2 being plugged-in. The numerical value which corresponds to the total volume capacity of pump module 2 plugged-in is written into a calculating circuit 33 via coding matrix 32. The direct preselection of liquid volume is performed by switch 7, the output of which carries a numerical value in coded representation. The binary coded pulse counter 34 being connected to the output of switch 7 utilizes this numerical value corresponding to the preselected liquid volume as initial value from which may be counted down to value zero. The contents of counter 34 is fed to a comparator network 38 in which a value zero as reference is noted via permanent wiring 39. An output signal is generated by the comparator 38 to close gate 35 and to terminate the piston motion when the contents of the pulse counter 34 has reached the value zero in coincidence with the reference value of the comparator 38. By actuating the starting push button 11, which is connected to gate 35 and pulse counter 34, the gate 35 is opened and the numerical value corresponding to preselected liquid volume is written into the binary coded pulse counter 34 and stored therein. Moreover, the count down function is released to the same time. The pulse train delivered by the impulse generator 36 passes the activated gate 35 and is then applied to the calculating circuit 33 which divides the pulse frequency by a specific value being coded in the matrix 32 and dependent on the pump module 2 plugged-in. The output pulse frequency from calculating circuit 33 is fed to counter 34. With the receipt of each pulse the counter 34 counts down to zero from the preselected numerical value as initial value. The comparator 38 compares continually its reference value with the contents of the counter 34. If the contents of counter 34 reaches zero in coincidence with the reference value of the comparator 38, then the comparator 38 generates an output signal through which the gate 35 will close causing the piston motion to terminate. Thus, a preselected precise quantity of liquid to be dispensed is functionally correlated with the corresponding piston stroke. As an example, the number 8 is stored in the coding matrix 32 as a divisor for the calculating circuit 33, when the maximum piston stroke is corresponding to 800 rotary steps of the driving motor 14 and when a pump module 2 having a total volume capacity of 100 μl is plugged-in. If a liquid quantity of 26 μl is set directly by switch 7, as shown in FIG. 1, and the starting push button 11 is actuated, the counter 34 counts down to zero from the initial value 26 whereafter the gate 35 will close. Before this point is reached, $8\times26=208$ pulses are fed to the stepper motor 14 causing the piston to move in such a way that the preselected quantity of liquid will be exactly taken in or discharged.

A preferred form of the present invention may use a microprocessor. The complete control of all functions of the apparatus, such as calculation of the piston stroke in dependence of the preselected quantity of liquid and the total volume capacity of pump module (2), the control of the start and stop characteristic of the piston motion, and switching of the valves can be monitored easily by using a commercial microprocessor, for instance an Intel 8080 microprocessor. Furthermore, the use of microprocessors permits the feature to set the operation parameters by remote control via serial or parallel data inputs.

Figure 5A:
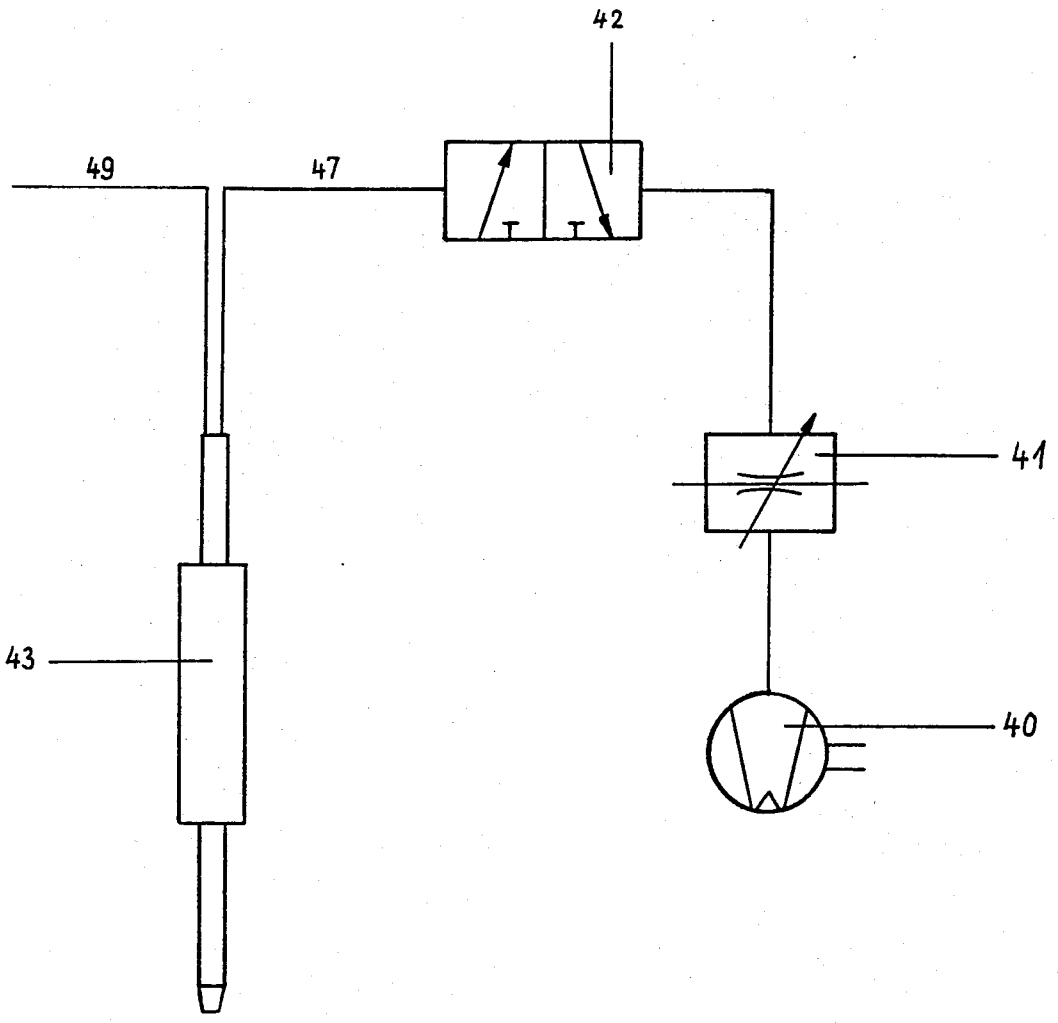
FIG. 5*a* shows a block diagram of the hand pipette for transferring of liquids by means of an auxiliary pump accessory.
Figure 5B:
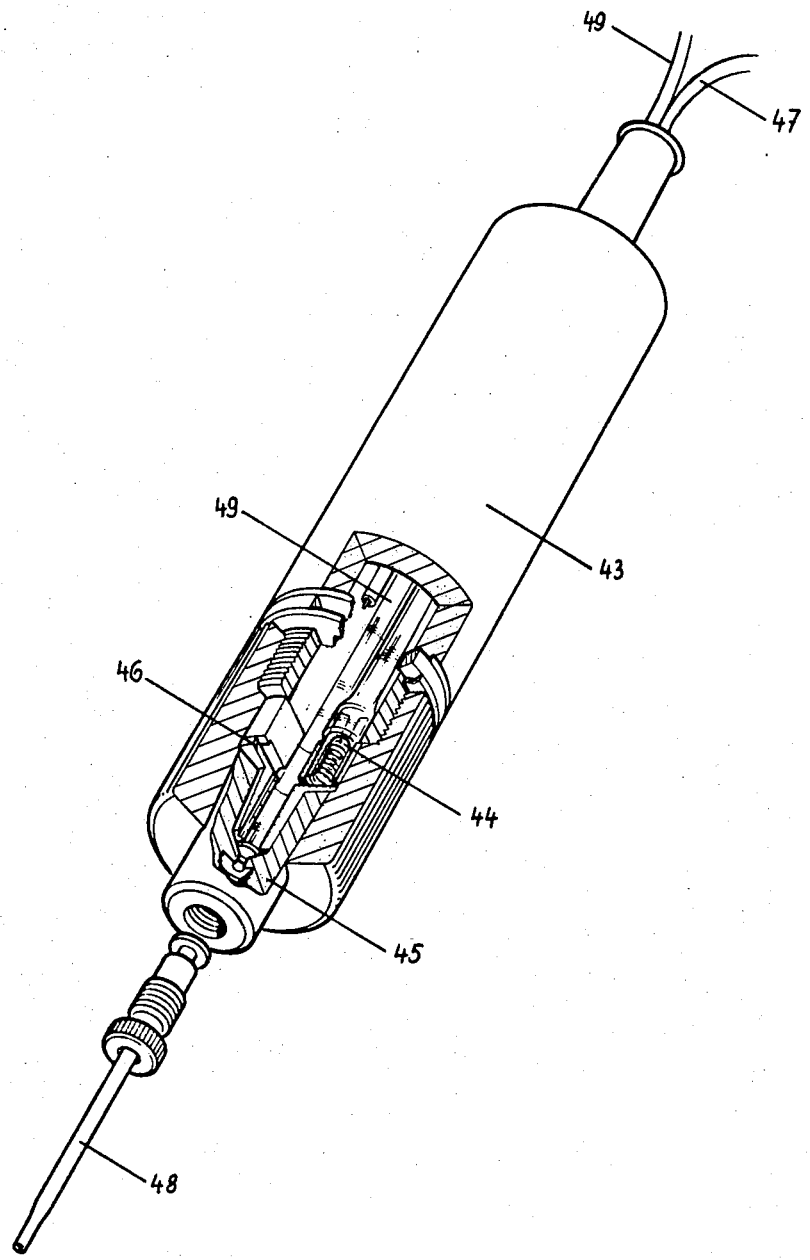
FIG. 5*b* is a perspective representation of the hand pipette for transfer of liquids.

For pipetting liquids up to 100 μl quantitatively an accessory consisting of a hand pipette and an auxiliary diaphragm pump is provided, which may be adapted to the apparatus described in order to feed a gas phase into the tip of the hand pipette which separates the sample from the liquid end of the diluent eliminating diffusion of the one into the other. FIG. 5*a* and 5*b* illustrate the essential components of the above accessory as embodiment comprising a diaphragm pump 40 connected to a needle valve 41 for dosing the quantity of gas as well as to a solenoid valve 42 for venting the gas tubing and a hand pipette 43 adapted to the apparatus being depicted in FIG. 1. As seen in FIG. 5*b*, the hand pipette 43 consists of a tip 48, a hose coupling with check valve 44, a nozzle 46 and an adapter 45 which allows the gas to get in touch with the liquid being pipetted. For the purpose of gas supplying, which operates synchronously on each discharge stroke or after termination of piston stroke, the solenoid valve 42 is open, so that the gas which can be controlled by a needle valve 41 is fed to the tip 48 via hose 47. At the head of the tip 48 a check valve 44 is arranged which opens by the gas pressure and prevents liquid to flow back into the pneumatic system. Furthermore, the nozzle 46 ensures a uniform distribution of the gas over the cross section of the tip 48 of the hand pipette 43. The dosing pump 2 is associated with the hose coupling via hose 49 by means of a gastight adapter 45. The aforesaid arrangement is able to eliminate all liquid from the tip 48 before the intake stroke is actuated. Thereafter a quantity of liquid is sucked from a sample tube in tip 48 without getting in touch with the conveying medium of the pump 2. The gas is flowing into the tip 48 while the sample is discharged.

What is claimed is:

1. Pipetting and diluting apparatus for dosages of small quantities of liquids with direct digital volume setting in milliliter or microliter units having 2 independent positive displacement pumps from which under insertion of suitable transmission means the pistons are driven by separate stepper motors being fed by an impulse generator, switching valves mounted at the head of pump cylinders and a calculating circuit as well as a comparator circuit, wherein the improvement comprises electronic calculating and comparator means for calculating automatically the piston stroke in dependence on the digital preselected quantity of liquid and the total volume capacity of the pump module (2) plugged-in, and electronic control means for controlling the slope of start and stop characteristic of the piston motion according to a time base wherein the digital preselected piston speed and the total volume capacity of module (2) determine the period of acceleration and deceleration.

2. Pipetting and diluting apparatus for small volumes of liquid with direct digital selection of said volumes in milliliter or microleter units, comprising a unit of two independently operating and interchangeable piston-type pump modules with the pistons being driven via transmission elements by separate stepping motors each fed by pulses from a pulse generator with direct digital selection of the speed of said pistons, distinguished by the combination of calculation and comparison means for automatically calculating the piston displacement distance as a function of a digitally preselected liquid volume and the total volume of the pump module being used, and electrical control means for both starting and stopping the piston motion according to a time-dependent exponential acceleration, such that the controlling variables for the time-dependent expression in the exponential function are the digitally preselected piston speed and the total volume of the pump module.

3. Apparatus for operating a pump having a displaceable piston driven by a stepping motor controlled by pulses from a pulse generator to take in or discharge a preselected liquid volume comprising:

means for calculating the piston displacement distance as a function of the preselected liquid volume and the total liquid volume of the pump; and means for controlling acceleration and deceleration of the piston in accordance with an exponential function dependent upon a preselected piston speed and the total liquid volume of the pump.

4. Pipetting and diluting apparatus comprising two pumps each as defined by and operated in accordance with the apparatus of claim 3.

* * * * *